US007659238B2

(12) United States Patent
Martin et al.

(10) Patent No.: US 7,659,238 B2
(45) Date of Patent: Feb. 9, 2010

(54) FABRIC SOFTENER COMPOSITIONS COMPRISING HOMO- AND/OR COPOLYMERS

(75) Inventors: Emmanuel Martin, Folgensbourg (FR); Keith Graham, Huddersfield (GB); David Normington, Leeds (GB); Malcolm Skinner, Bradford (GB)

(73) Assignee: Ciba Specialty Chemicals Corp., Tarrytown, NY (US)

( * ) Notice: Subject to any disclaimer, the term of this patent is extended or adjusted under 35 U.S.C. 154(b) by 480 days.

(21) Appl. No.: 10/536,607

(22) PCT Filed: Nov. 19, 2003

(86) PCT No.: PCT/EP03/50847

§ 371 (c)(1),
(2), (4) Date: May 25, 2005

(87) PCT Pub. No.: WO2004/050812

PCT Pub. Date: Jun. 17, 2004

(65) Prior Publication Data

US 2006/0094639 A1 May 4, 2006

(30) Foreign Application Priority Data

Nov. 29, 2002 (EP) ..... 02406043

(51) Int. Cl.
*C11D 3/37* (2006.01)

(52) U.S. Cl. ..... 510/515; 510/522; 252/8.81; 524/555

(58) Field of Classification Search ..... 510/515, 510/522, 527; 252/8.81; 524/555
See application file for complete search history.

(56) References Cited

U.S. PATENT DOCUMENTS

| | | | | |
|---|---|---|---|---|
| 4,806,345 | A * | 2/1989 | Bhattacharyya | 514/772.4 |
| 5,114,600 | A | 5/1992 | Biggin et al. | 252/86 |
| 5,964,939 | A | 10/1999 | Fox et al. | 106/516 |
| 6,020,304 | A | 2/2000 | Ceulemans et al. | 510/527 |
| 6,271,192 | B1 | 8/2001 | Verstrat et al. | 510/527 |
| 6,451,756 | B2 * | 9/2002 | Shulman et al. | 510/475 |
| 6,864,223 | B2 * | 3/2005 | Smith et al. | 510/475 |
| 2001/0046952 | A1 | 11/2001 | Verstrat et al. | 510/327 |
| 2002/0132749 | A1 | 9/2002 | Smith et al. | 510/327 |

FOREIGN PATENT DOCUMENTS

| | | |
|---|---|---|
| DE | 101 16 491 | 10/2002 |
| EP | 0494554 | 7/1992 |
| EP | 0799887 | 10/1997 |
| EP | 1099749 | 5/2001 |
| GB | 1079388 | 8/1967 |
| WO | 90/12862 | 11/1990 |
| WO | 94/24255 | 10/1994 |
| WO | 97/28239 | 8/1997 |
| WO | 02/057400 | 7/2002 |

OTHER PUBLICATIONS

136/Research Disclosure 429116, "Cationic polymeric thickeners useful in fabric softeners", Jan. 2000.
English language Derwent Abstract AN 2003-240737 [24] for DE 101 16 491 (Oct. 2002).

* cited by examiner

*Primary Examiner*—Helen L. Pezzuto
(74) *Attorney, Agent, or Firm*—Joseph C. Suhadolnik

(57) ABSTRACT

This invention relates to fabric softener compositions comprising a fabric softener component or a mixture of fabric softener components and at least one polymer formed from the polymerization of c) a water soluble ethylenically unsaturated monomer or blend of monomers comprising at least one cationic monomer and/or at least one non-ionic monomer, d) a cross-linking agent or a mixture of cross-linking agents in an amount of less than 5 ppm by the weight of component a), and c) optionally at least one chain transfer agent, with the proviso that (i) if the polymer is a cationic homopolymer then the amount of the crosslinking agent is always more than 0 ppm, as thickeners, as well as to new fabric softener compositions.

11 Claims, No Drawings

FABRIC SOFTENER COMPOSITIONS COMPRISING HOMO- AND/OR COPOLYMERS

This invention relates to fabric softener compositions comprising homo- and/or copolymers as thickeners, as well as to new fabric softener compositions.

It is standard practice to include viscosifying polymers in fabric softener compositions in order to achieve optimum rheology characteristics. Various polymer types have been proposed for the purpose of increasing the viscosity of fabric softener compositions.

WO-A-90/12862 describes fabric softener compositions, which include cationic polymers with 5 to 45 ppm cross-linking agents.

Although the polymers used in aqueous compositions described in the prior art do achieve viscosification of the composition, there is still a need to provide further improvement in rheology profile. This is particularly important where the fabric softener composition is expected to perform under a number of different conditions and environments.

The invention relates to fabric softener compositions comprising a fabric softener component or a mixture of fabric softener components and at least one polymer formed from the polymerisation of a) a water soluble ethylenically unsaturated monomer or blend of monomers comprising at least one cationic monomer and/or at least one non-ionic monomer, b) at least one cross-linking agent in an amount of less than 5 ppm by the weight of component a), and c) optionally at least one chain transfer agent, with the proviso that (i) if the polymer is a cationic homopolymer then the amount of the crosslinking agent is always more than 0 ppm.

The used polymer can be added to the composition in solid or liquid form.

The solid form can be further classified into (i) powder, or (ii) beads, which are non-dusting particles.

If the polymer is added to the composition in solid form, the beads form is preferred.

The polymer is added to the composition while in the form of particles, which have a volume average size of more than 10 μm and up to 1000 μm, preferably more than 50 μm, especially preferred from 100 μm and up to 1000 μm. The size of the particles can be determined by known methods, i.e. with laser diffraction.

In a preferred embodiment of the invention, the polymer is a cationic homopolymer.

In a further preferred embodiment of the invention, the polymer is a non-ionic homopolymer.

In a further preferred embodiment of the invention, the component a) comprises 5-95% by weight (wt-%) of at least one cationic monomer and 5-95 wt-% of at least one non-ionic monomer. The weight percentages relate to the total weight of the copolymer.

In a more preferred embodiment of the invention, the component a) comprises 30-95 wt-% of at least one cationic monomer and 5-70 wt-% of at least one non-ionic monomer. The weight percentages relate to the total weight of the copolymer.

In an even more preferred embodiment of the invention, the component a) comprises 35-95 wt-% of at least one cationic monomer and 5-65 wt-% of at least one non-ionic monomer.

The weight percentages relate to the total weight of the copolymer.

In an especially preferred embodiment of the invention, the component a) comprises 40-95 wt-% of at least one cationic monomer and 5-60 wt-% of at least one non-ionic monomer.

The weight percentages relate to the total weight of the copolymer.

In a very especially preferred embodiment of the invention, the component a) comprises 50-95 wt-% of at least one cationic monomer and 5-50 wt-% of at least one non-ionic monomer. The weight percentages relate to the total weight of the copolymer.

Preferred cationic monomers are diallyl dialkyl ammonium halides or compounds according to formula (I)

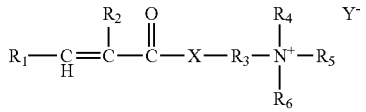

(I)

wherein $R_1$ signifies hydrogen or methyl, $R_2$ signifies hydrogen or $C_1$-$C_4$alkyl, $R_3$ signifies $C_1$-$C_4$alkylene, $R_4$, $R_5$ and $R_6$ signify independently from each other hydrogen or $C_1$-$C_4$alkyl, X signifies —O— or —NH— and Y signifies Cl; Br; I; hydrogensulphate or methosulfate.

The alkyl groups may be linear or branched. The alkyl groups are methyl, ethyl, propyl, butyl and isopropyl.

Preferred non-ionic monomers are N-vinyl pyrrolidone or compounds of formula (II)

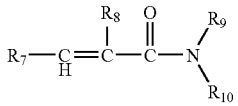

(II)

wherein $R_7$ signifies hydrogen or methyl, $R_8$ signifies hydrogen or $C_1$-$C_4$alkyl, and $R_8$ and $R_{10}$ signify independently from each other hydrogen or $C_1$-$C_4$alkyl.

Preferably, the cross-linking agent b) contains at least two ethylenically unsaturated moieties. Suitable preferred cross-linking agents are divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers, such as polyallylsaccharose and pentaerythrol triallylether.

More preferred cross-linking agents are tetra allyl ammonium chloride; allyl-acrylamides and allyl-methacrylamides; bisacrylamidoacetic acid and N,N'-methylene-bisacrylamide.

The most preferred cross-linking agents are tetra allyl ammonium chloride and N,N'-methylene-bisacrylamide.

It is also suitable to use mixtures of cross-linking agents.

The cationic homopolymer is always crosslinked by at least one cross-linking agent b).

Preferably, the crosslinker(s) is (are) included in the range of up to 4.5 ppm (based on the component a), more preferably 0.5-4.5 ppm.

Preferably, the chain transfer agent c) is selected from mercaptanes, malic acid, lactic acid, formic add, isopropanol and hypophosphites.

In a preferred embodiment of the invention the chain transfer agent c) is present in a range of from 0 to 1000 ppm, more preferably 0-500 ppm, most preferably 0-300 ppm (based on the component a).

It is also suitable to use mixtures of chain transfer agents.

In a preferred embodiment of the present invention, the fabric softener composition comprises at least one copolymer and/or homopolymer formed from the polymerisation of a) at least one monomer of formula (Ia)

(Ia)

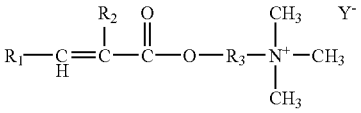

wherein $R_1$ signifies hydrogen or methyl, $R_2$ signifies hydrogen or methyl, $R_3$ signifies $C_1$-$C_2$alkylene and Y signifies Cl; Br or I, and b) at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of more than 0 ppm and less than 5 ppm (based on the component a), and c) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a) with the provisio that if the polymer is a homopolymer then the amount of the crosslinking agent is always more than 0 ppm.

In a further preferred embodiment of the present invention, the fabric softener composition comprises at least one copolymer and/or homopolymer formed from the polymerisation of a) at least one monomer of formula (IIa)

(IIa)

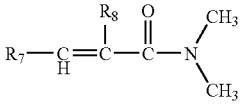

wherein $R_7$ signifies hydrogen or methyl, and $R_8$ signifies hydrogen; methyl or ethyl, b) optionally at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of less than 5 ppm (based on the component a), and c) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a).

In a more preferred embodiment of the present invention, the fabric softener composition comprises at least one copolymer formed from the polymerisation of a) 5-95 wt-%, preferably 30-95 wt-%, more preferably 35-95 wt-%, even more preferably 40-95 wt-%, especially preferably 50-95 wt-%, based on the total weight of the copolymer, of at least one monomer of formula (Ia)

(Ia)

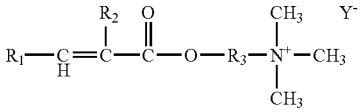

wherein $R_1$ signifies hydrogen or methyl, $R_2$ signifies hydrogen or methyl, $R_3$ signifies $C_1$-$C_2$alkylene and Y signifies Cl; Br or I, and b) 5-95 wt-%, preferably 5-70 wt-%, more preferably 5-65 wt-%, even more preferably 5-60 wt-%, especially preferably 5-50 wt-%, based on the total weight of the copolymer, of at least one monomer of formula (IIa)

(IIa)

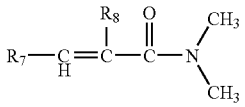

wherein $R_7$ signifies is hydrogen or methyl, and $R_8$ signifies hydrogen; methyl or ethyl, c) optionally at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of less than 5 ppm (based on the component a), and d) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a).

The fabric softener can be any common fabric softener compound as well as mixtures of fabric softener compounds.

Fabric softener components, especially hydrocarbon fabric softener components, suitable for use herein are selected from the following classes of compounds:

(i) Cationic quaternary ammonium salts. The counter ion of such cationic quaternary ammonium salts may be a halide, such as chloride or bromide, methyl sulphate, or other ions well known in the literature. Preferably the counter ion is methyl sulfate or any alkyl sulfate or any halide, methyl sulfate being most preferred for the dryer-added articles of the invention.

Examples of cationic quaternary ammonium salts include but are not limited to:

(1) Acyclic quaternary ammonium salts having at least two $C_8$ to $C_{30}$, preferably $C_{12}$ to $C_{22}$ alkyl or alkenyl chains, such as: ditallowdimethyl ammonium methylsulfate, di(hydrogenated tallow)dimethyl ammonium methylsulfate, di(hydrogenated tallow)dimethyl ammonium methylchloride, distearyldimethyl ammonium methyl-sulfate, dicocodimethyl ammonium methylsulfate and the like. It is especially preferred if the fabric softening compound is a water insoluble quaternary ammonium material which comprises a compound having two $C_{12}$ to $C_{18}$ alkyl or alkenyl groups connected to the molecule via at least one ester link. It is more preferred if the quaternary ammonium material has two ester links present. An especially preferred ester-linked quaternary ammonium material for use in the invention can be represented by the formula:

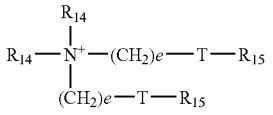

wherein each $R_{14}$ group is independently selected from $C_1$ to $C_4$ alkyl, hydroxyalkyl or $C_2$ to $C_4$ alkenyl groups; T is either —O—C(O)— or —C(O)O—, and wherein each $R_{15}$ group is independently selected from $C_8$ to $C_{28}$ alkyl or alkenyl groups; and e is an integer from 0 to 5.

A second preferred type of quaternary ammonium material can be represented by the formula:

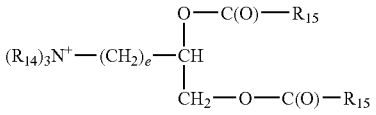

wherein $R_{14}$, e and $R_{15}$ are as defined above.

(2) Cyclic quaternary ammonium salts of the imidazolinium type such as di(hydrogenated tallow)dimethyl imidazolinium methylsulfate, 1-ethylene-bis(2-tallow-1-methyl) imidazolinium methylsulfate and the like;

(3) Diamido quaternary ammonium salts such as: methyl-bis (hydrogenated tallow amidoethyl)-2-hydroxethyl ammonium methyl sulfate, methyl bi(tallowamidoethyl)-2-hydroxypropyl ammonium methylsulfate and the like;

(4) Biodegradable quaternary ammonium salts such as N,N-di(tallowoyl-oxy-ethyl)-N,N-dimethyl ammonium methyl sulfate and N,N-di(tallowoyl-oxy-propyl)-N,N-dimethyl ammonium methyl sulfate. Biodegradable quaternary ammonium salts are described, for example, in U.S. Pat. Nos. 4,137,180, 4,767,547 and 4,789,491 Incorporated by reference herein.

Preferred biodegradable quaternary ammonium salts include the biodegradable cationic diester compounds as described in U.S. Pat. No. 4,137,180, herein incorporated by reference.

(ii) Tertiary fatty amines having at least one and preferably two $C_8$ to $C_{30}$, preferably $C_{12}$ to $C_{22}$ alkyl chains. Examples include hardened tallow-di-methylamine and cyclic amines such as 1-(hydrogenated tallow)amidoethyl-2-(hydrogenated tallow) imidazoline. Cyclic amines, which may be employed for the compositions herein, are described in U.S. Pat. No. 4,806,255 incorporated by reference herein.

(iii) Carboxylic acids having 8 to 30 carbons atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and palmitic acid, and mixtures thereof, which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN® 60 (ICI) which is a mixture of sorbitan and isosorbide stearates.

(v) Fatty alcohols, ethoxylated fatty alcohols, alkylphenols, ethoxylated alkylphenols, ethoxylated fatty amines, ethoxylated monoglycerides and ethoxylated diglycerides.

(vi) Mineral oils, and polyols such as polyethylene glycol.

These softeners are more definitively described in U.S. Pat. No. 4,134,838 the disclosure of which is incorporated by reference herein. Preferred fabric softeners for use herein are acyclic quaternary ammonium salts. Mixtures of the above mentioned fabric softeners may also be used.

The fabric softening composition employed in the present invention preferably contains about 0.1 to about 95 wt-%, based on the total weight of the fabric softening composition, of the fabric softening component. Preferred is an amount of 0.5 to 50 wt-%, especially an amount of 2 to 50 wt-% and most preferably an amount of 2 to 30 wt-%.

The amount of the polymer in the fabric softening composition is preferably 0.001 to 15 wt-%, based on the total weight of the fabric softening composition. Preferred is an amount of 0.01 to 10 wt-%, especially an amount of 0.05 to 5 wt-% and most preferably an amount of 0.1 to 5 wt-%.

The fabric softening composition may also comprise additives which are customary for standard commercial fabric softening compositions, for example alcohols, such as ethanol, n-propanol, i-propanol, polyhydric alcohols, for example glycerol and propylene glycol; amphoteric and nonionic surfactants, for example carboxyl derivatives of imidazole, oxyethylated fatty alcohols, hydrogenated and ethoxylated castor oil, alkyl polyglycosides, for example decyl polyglucose and dodecylpolyglucose, fatty alcohols, fatty acid esters, fatty acids, ethoxylated fatty acid glycerides or fatty acid partial glycerides; also inorganic or organic salts, for example water-soluble potassium, sodium or magnesium salts, non-aqueous solvents, pH buffers, perfumes, chelating agents, dyes, hydrotropic agents, antifoams, anti redeposition agents, enzymes, optical brighteners, antishrink agents, stain removers, germicides, fungicides, dye fixing agents or dye transfer inhibitors (as described in WO-A-02/02865), antioxidants, corrosion inhibitors, wrinkle recovery or wet soiling reduction agent, such as polyorganosiloxanes. The latter two additives are described in WO0125385.

Such additives are preferably used in an amount of 0 to 30 wt-%, based on the total weight of the fabric softening composition. Preferred is an amount of 0 to 20 wt-%, especially an amount of 0 to 10 wt-% and most preferably an amount of 0 to 5 wt-%.

The fabric softener compositions are preferably in liquid aqueous form. The fabric softener compositions preferably contain a water content of 25 to 90 wt-% based on the total weight of the composition. More preferably, the water content is 50 to 90 wt-%, especially 60 to 90 wt-%.

The fabric softener compositions preferably have a pH value from 2.0 to 9.0, especially 2.0 to 5.0.

The fabric softener compositions can, for example, be prepared as follows:

Firstly, an aqueous formulation of the polymer is prepared as described above. The fabric softener composition according to the invention is usually, but not exclusively, prepared by firstly stirring the active substance, i.e. the hydrocarbon based fabric softening component, in the molten state into water, then, where required, adding further desired additives and, finally, adding the formulation of the cationic polymer. The fabric softener composition can, for example, also be prepared by mixing a preformulated fabric softener with the polymer. It is also possible to add independently the components of the softener and the additives to the aqueous solution of the polymer (preaddition).

These fabric softener compositions are traditionally prepared as dispersions containing for example up to 30 wt-% of active material in water. They usually have a turbid appearance. However, alternative formulations usually containing actives at levels of 5 to 40% along with solvents can be prepared as microemulsions, which have a clear appearance (as to the solvents and the formulations see for example U.S. Pat. No. 5,543,067 und WO-A-98/17757).

A highly preferred fabric softener composition according to the present invention is in liquid form and comprises:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-%, based on the total weight of the composition, of at least one copolymer and/or homopolymer formed from the polymerisation of a) at least one monomer of formula (Ia)

(Ia)

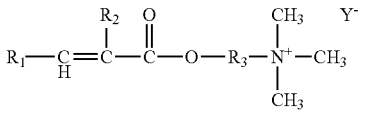

wherein $R_1$ signifies hydrogen or methyl, $R_2$ signifies hydrogen or methyl, $R_3$ signifies $C_1$-$C_2$alkylene and Y signifies Cl; Br or I, and b) at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of less than 5 ppm (based on the component a), and c) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a); with the provisio, that if the polymer is a homopolymer then the amount of the crosslinking agent is always more than 0 ppm;

C) 0 to 20 wt-%, based on the total weight of the composition, of customary additives; and D) water to 100%.

A further highly preferred fabric softener composition according to the present invention is in liquid form and comprises:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-%, based on the total weight of the composition, of at least one copolymer and/or homopolymer formed from the polymerisation of a) at least one monomer of formula (IIa)

(IIa)

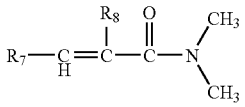

wherein $R_7$ signifies hydrogen or methyl, and $R_8$ signifies hydrogen; methyl or ethyl, b) optionally at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetc acid; N,N'-methylene-bisacrylamide and polyol polyallylethers in an amount of less than 5 ppm (based on the component a), and c) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a);

C) 0 to 20 wt-%, based on the total weight of the composition, of customary additives; and D) water to 100%.

A further highly preferred fabric softener composition according to the present invention is in liquid form and comprises:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-%, based on the total weight of the composition, of at least one copolymer formed from the polymerisation of a) 5-95 wt-%, preferably 30-95 wt-%, more preferably 35-95 wt-%, even more preferably 40-95 wt-%, especially preferably 50-95 wt-%, based on the total weight of the copolymer, of at least one monomer of formula (Ia)

(Ia)

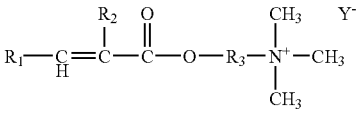

wherein $R_1$ signifies hydrogen or methyl, $R_2$ signifies hydrogen or methyl, $R_3$ signifies $C_1$-$C_2$alkylene and Y signifies Cl; Br or I, and b) 5-95 wt-%, preferably 5-70 wt-%, more preferably 5-65 wt-%, even more preferably 5-65 wt-%, especially preferably 5-50 wt-%, based on the total weight of the copolymer, at least one monomer of formula (IIa)

(IIa)

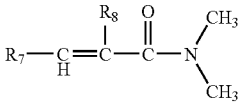

wherein $R_7$ signifies is hydrogen or methyl, and $R_8$ signifies hydrogen; methyl or ethyl, c) optionally at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic add; N,N'-methylene-bisacrylamide and polyol polyallylethers in an amount of less than 5 ppm (based on the component a), and d) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a);

C) 0 to 20 wt-%, based on the total weight of the composition, of customary additives; and D) water to 100%.

An important fabric softener composition according to the present invention is in liquid form and comprises:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-%, based on the total weight of the composition, of at least one copolymer with an average particle size of more than 10 μm and up to 1000 μm, preferably more than 50 μm, especially preferred from 100 μm and up to 1000 μm formed from the polymerisation of a) 5-95 wt-%, preferably 30-95 wt-%, more preferably 35-95 wt-%, even more preferably 40-95 wt-%, especially preferably 50-95 wt-%, based on the total weight of the copolymer, of at least one monomer of formula (Ia)

(Ia)

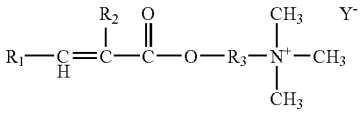

wherein $R_1$ signifies hydrogen or methyl, $R_2$ signifies hydrogen or methyl, $R_3$ signifies $C_1$-$C_2$alkylene and Y signifies Cl; Br or I, and b) 5-95 wt-%, preferably 5-70 wt-%, more preferably 5-65 wt-%, even more preferably 5-65 wt-%, especially preferably 5-50 wt-%, based on the total weight of the copolymer, at least one monomer of formula (IIa)

(IIa)

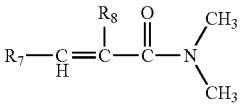

wherein $R_7$ signifies is hydrogen or methyl, and $R_8$ signifies hydrogen; methyl or ethyl, c) optionally at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of less than 5 ppm (based on the component a), and d) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a);

C) 0 to 20 wt-%, based on the total weight of the composition, of customary additives; and D) water to 100%.

The fabric softener compositions may also comprise a perfume as a customary additive. Perfume is preferably used in an amount of 0 to 5 wt-%, based on the total weight of the composition. Preferred is an amount of 0 to 3 wt-%, especially an amount of 0 to 2 wt-%, based on the total amount of the composition.

The term "perfume" or "fragrance" as used herein refers to odoriferous materials which are able to provide a pleasing fragrance to fabrics, and encompasses conventional materials commonly used in detergent compositions to counteract a malodor in such compositions and/or provide a pleasing fragrance thereto. The perfumes are preferably in the liquid state at ambient temperature, although solid perfumes are also useful. Included among the perfumes contemplated for use herein are materials such as aldehydes, ketones, esters and the like which are conventionally employed to impart a pleasing fragrance to liquid and granular detergent compositions. Naturally occurring plant and animal oils are also commonly used as components of perfumes. Accordingly, the perfumes useful for the present invention may have relatively simple compositions or may comprise complex mixtures of natural and synthetic chemical components, all of which are intended to provide a pleasant odour or fragrance when applied to fabrics. The perfumes used in detergent compositions are generally selected to meet normal requirements of odour, stability, price and commercial availability. The term "fragrance" is often used herein to signify a perfume itself, rather than the aroma imparted by such perfume.

A further important embodiment of the present invention is a liquid fabric softener composition comprising:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-% based on the total weight of the composition, of at least one polymer as defined above;

C) 0 to 20 wt-%, based on the total weight of the composition, of customary additives;

D) 0 to 5 wt-%, preferably 0 to 3 wt-%, more preferably 0 to 2 wt-%, based on the total weight of the composition, of a perfume; and E) water to 100%.

As a further customary additive, the fabric softener compositions may also comprise at least one component capable of sequestering properties, that is a component which acts to sequester (chelate) metal ions. Such compound may be selected from the group consisting of a chelating component, a polycarboxylic building component and mixtures thereof.

Chelating components are present at a level of up to 0.5%, more preferably from 0.005% to 0.25%, most preferably from 0.01% to 0.1 wt-%, based on the total weight of the composition.

Suitable chelating components for use in the present invention are selected from the group consisting of amino carboxylic acid, organo aminophosphonic acid compounds, and mixture thereof.

Chelating components, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the chelating component is preferably at least 1:1.

Suitable chelating components for use herein include the amino carboxylic acids such as ethylenediamine-N,N'-disuccinic acid (EDDS), ethylenediamine tetraacetic acid (EDTA), N-hydroxyethylenediamine triacetic acid, nitrilotriacetic add (NTA), ethylene diamine tetrapropionic acid, ethylenediamine-N,N'-diglutamic acid, 2-hydroxypropylenediamine-N,N'-disuccinic acid, triethylenetetraamine hexacetic acid, diethylenetriamine pentaacetic acid (DETPA), trans 1,2 diaminocyclohexane-N,N,N',N'-tetraacetic acid or ethanoldiglycine.

Other suitable chelating components for use herein include the organo aminophosphonic acids such as ethylenediamine tetrakis (methylenephosphonic acid), diethylene triamine-N,N,N',N",N"-pentakis (methylene phosphonic acid) (DETMP), 1-hydroxyethane 1,1-diphosphonic acid (HEDP) or hydroxyethane dimethylenephosphonic acid.

Mixture of any of the herein before described chelating components can also be used.

Especially preferred is ethylenediamine-N,N'-disuccinic acid (EDDS), most preferably present in the form of its S,S-isomer, which is preferred for its biodegradability profile.

Polycarboxylic building components are present at a level of up to 0.045 wt-% (450 ppm), preferably at a level of from 0.045 to 0.5 wt-%, more preferably from 0.09 to 0.25 wt-%, most preferably from 0.1 to 0.2 wt-%, based on the total weight of the composition.

Suitable polycarboxylic building components for use herein can be monomeric or oligomeric in type although monomeric polycarboxylates are generally preferred for reasons of cost and performance.

Polycarboxylic acids containing two carboxy groups include succinic acid, malonic acid, (ethylenedioxy) diacetic acid, maleic acid, diglycolic acid, tartaric acid, tartronic acid and fumaric acid, as well as the ether carboxylic acid and the sulfinyl carboxylic acids.

Polycarboxylic acids containing three carboxy groups include, in particular, citric acid, aconitric and citraconic as well as succinic derivatives such as the carboxymethyloxysuccinic described in British Patent No. 1,379,241, lactoxysuccinic described in British Patent No. 1,389,732, and aminosuccinic described in Netherlands Application 7205873, and the oxypolycarboxylic materials such as 2-oxa-1,1,3-propane tricarboxylic described in British Patent No. 1,387,447.

Polycarboxylic containing four carboxy groups include oxydisuccinic disclosed in British Patent No. 1,261,829, 1,1,2,2-ethane tetracarboxylic, 1,1,3,3-propane tetracarboxylic and 1,1,2,3-propane tetracarboxylic. Polycarboxylic containing sulfo substituents include the sulfosuccinate derivatives disclosed in British Patent Nos. 1,398,421 and 1,398,422 and in U.S. Pat. No. 3,936,448, and the sulfonated pyrolysed citric described in British Patent No. 1,439,000.

Alicyclic and heterocyclic polycarboxylic include cyclopentane-cis,cis,cis-tetracarboxylic, cyclopentadienide pentacarboxylic, 2,3,4,5-tetrahydrofuran-cis, cis, cis-tetracarboxylic, 2,5-tetrahydrofuran-cis-dicarboxylic, 2,2,5,5-tetrahydrofuran-tetracarboxylic, 1,2,3,4,5,6-hexanehexacarboxylic and carboxymethyl derivatives of polyhydric alcohols such as sorbitol, mannitol and xylitol. Aromatic polycarboxylic include mellitic acid, pyromellitic acid and the phthalic acid derivatives disclosed in British Patent No. 1,425,343. Although suitable for use, citric acid is less preferred for the purpose of the invention.

Of the above, the preferred polycarboxylic are carboxylic containing up to three carboxy groups per molecule, more particularly maleic acid.

A further important embodiment of the present invention is a liquid fabric softener composition comprising:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-% based on the total weight of the composition, of at least one homo- and/or copolymer formed from the polymerisation of a) at least one monomer of formula (Ia)

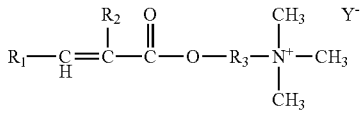

(Ia)

wherein $R_1$ signifies hydrogen or methyl, $R_2$ signifies hydrogen or methyl, $R_3$ signifies $C_1$-$C_2$alkylene and Y signifies Cl; Br or I, and b) at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of less than 5 ppm (based on the component a), and c) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a); with the provisio if the polymer is a homopolymer then the amount of the crosslinking agent is always more than 0 ppm;

C) 0 to 20 wt-%, based on the total weight of the composition, of customary additives; and D) 0 to 5 wt-%, preferably 0 to 3 wt-%, more preferably 0 to 2 wt-%, based on the total weight of the composition, of a perfume E) 0 to 0.5 wt-%, preferably 0.005 to 0.25 wt-%, more preferably 0.01 to 0.1 wt-%, based on the total weight of the composition, a component capable of sequestering metal ions and selected from the group consisting of i) chelating components selected from the group consisting of amino carboxylic acid, organo aminophosphonic acid components, and mixtures thereof, ii) polycarboxylic building components, other than those defined under i) as chelating components, comprising at least two carboxylic radicals separated from each other by not more than two carbon atoms, and, iii) mixtures thereof, F) water to 100%.

A further important embodiment of the present invention is a liquid fabric softener composition comprising:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-% based on the total weight of the composition, of at least one homo- and/or copolymer formed from the polymerisation of a) at least one monomer of formula (IIa)

(IIa)

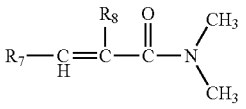

wherein $R_7$ signifies hydrogen or methyl, and $R_8$ signifies hydrogen; methyl or ethyl, b) optionally at least one cross-linking agent selected from divinyl benzene; tetra allyl ammonium chloride; allyl acrylates and methacrylates; diacrylates and dimethacrylates of glycols and polyglycols; butadiene; 1,7-tadiene; allyl-acrylamides and allyl-methacrylamides; bisacrylamidoacetic acid; N,N'-methylene-bisacrylamide and polyol polyallylethers in an amount of less than 5 ppm (based on the component a), and c) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a);

C) 0 to 20 wt-%, based on the total weight of the composition, of customary additives; and D) 0 to 5 wt-%, preferably 0 to 3 wt-%, more preferably 0 to 2 wt-%, based on the total weight of the composition, of a perfume;

E) 0 to 0.5 wt-%, preferably 0.005 to 0.25 wt-%, more preferably 0.01 to 0.1 wt-%, based on the total weight of the composition, a component capable of sequestering metal ions and selected from the group consisting of i) chelating components selected from the group consisting of amino carboxylic acid, organo aminophosphonic acid components, and mixtures thereof, ii) polycarboxylic building components, other than those defined under i) as chelating components, comprising at least two carboxylic radicals separated from each other by not more than two carbon atoms, and, iii) mixtures thereof; and F) water to 100%.

A further important embodiment of the present invention is a liquid fabric softener composition comprising:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-% based on the total weight of the composition, of at least copolymer formed from the polymerisation of a) 5-95 wt-%, preferably 30-95 wt-%, more preferably 35-95 wt-%, even more preferably 40-95 wt-%, especially preferably 50-95 wt-%, based on the total weight of the copolymer, of at least one monomer of formula (Ia)

(Ia)

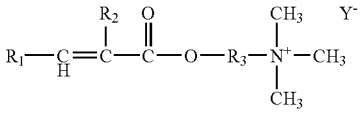

wherein $R_1$ signifies hydrogen or methyl, $R_2$ signifies hydrogen or methyl, $R_3$ signifies $C_1$-$C_2$alkylene and Y signifies Cl; Br or I, and b) 5-95 wt-%, preferably 5-70 wt-%, more preferably 5-65 wt-%, even more preferably 5-65 wt-%, especially preferably 5-50 wt-%, based on the total weight of the copolymer, at least one monomer of formula (IIa)

(IIa)

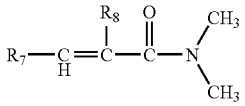

wherein $R_7$ signifies is hydrogen or methyl, and $R_8$ signifies hydrogen; methyl or ethyl, c) optionally at least one cross-linking agent selected from divinyl benzene; tetra allyl ammonium chloride; allyl acrylates and methacrylates; diacrylates and dimethacrylates of glycols and polyglycols; butadiene;

1,7-octadiene; allyl-acrylamides and allyl-methacrylamides; bisacrylamidoacetic acid; N,N'-methylene-bisacrylamide and polyol polyallylethers in an amount of less than 5 ppm (based on the component a), and d) optionally at least one chain transfer agent selected from mercaptanes; malic acid; lactic acid; formic acid; isopropanol and hypophosphites in an amount of 0-1000 ppm, preferably 0-500 ppm, more preferably 0-300 ppm (based on the component a);

C) 0 to 20 wt-%, based on the total weight of the composition, of customary additives;

D) 0 to 5 wt-%, preferably 0 to 3 wt-%, more preferably 0 to 2 wt-%, based on the total weight of the composition, of a perfume;

E) 0 to 0.5 wt-%, preferably 0.005 to 0.25 wt-%, more preferably 0.01 to 0.1 wt-%, based on the total weight of the composition, a component capable of sequestering metal ions and selected from the group consisting of:

i) chelating components selected from the group consisting of amino carboxylic add, organo aminophosphonic acid components, and mixtures thereof, ii) polycarboxylic building components, other than those defined under i) as chelating components, comprising at least two carboxylic radicals separated from each other by not more than two carbon atoms, and, iii) mixtures thereof; and F) water to 100%.

A very important embodiment of the present invention is a liquid fabric softener composition comprising:

A) 0.5 to 50 wt-%, preferably 2 to 50 wt-%, more preferably 2 to 30 wt-%, based on the total weight of the composition, of the fabric softener;

B) 0.001 to 15 wt-%, preferably 0.01 to 10 wt-%, more preferably 0.05 to 5 wt-%, most preferably 0.1 to 5 wt-% based on the total weight of the composition, of at least one copolymer with an average particle size of more than 10 μm and up to 1000 μm, preferably more than 50 μm, especially preferred from 100 μm and up to 1000 μm formed from the polymerisation of a) 5-95 wt-%, preferably 30-95 wt-%, more preferably 35-95 wt-%, even more preferably 40-95 wt-%, especially preferably 50-95 wt-%, based on the total weight of the copolymer, of at least one monomer of formula (Ia)

(Ia)

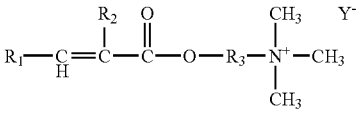

wherein $R_1$ signifies hydrogen or methyl, $R_2$ signifies hydrogen or methyl, $R_3$ signifies $C_1$-$C_2$alkylene and Y signifies Cl; Br or I, and b) 5-95 wt-%, preferably 5-70 wt-%, more preferably 5-65 wt-%, even more preferably 5-65 wt-%, especially preferably 5-50 wt-%, based on the total weight of the copolymer, at least one monomer of formula (IIa)

(IIa)

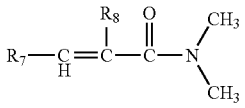

wherein $R_7$ signifies is hydrogen or methyl, and $R_8$ signifies hydrogen; methyl or ethyl, c) optionally at least one cross-linking agent selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of less than 5 ppm (based on the component a), and d) optionally at least one chain transfer agent selected from mercaptanes; malic acid; lactic acid; formic acid; isopropanol and hypophosphites in an amount of 0-1000 ppm, preferably 0.0-500 ppm, more preferably 0-300 ppm (based on the component a);

C) 0 to 20 wt-%, based on the total weight of the composition, of customary additives; and D) 0 to 5 wt-%, preferably 0 to 3 wt-%, more preferably 0 to 2 wt-%, based in the total weight of the composition, of a perfume;

E) 0 to 0.5 wt-%, preferably 0.005 to 0.25 wt-%, more preferably 0.01 to 0.1 wt-%, based in the total weight of the composition, a component capable of sequestering metal ions and selected from the group consisting of:

i) chelating components selected from the group consisting of amino carboxylic acid, organo aminophosphonic acid components, and mixtures thereof, ii) polycarboxylic building components, other than those defined under i) as chelating components, comprising at least two carboxylic radicals separated from each other by not more than two carbon atoms, and, iii) mixtures thereof; and F) water to 100%.

The fabric softener compositions can also be used in the form of tumble dryer sheet composition. In tumble dryer applications the compositions are usually incorporated into impregnates on non-woven sheets. However, other application forms are known. The polymers used in the acidic aqueous compositions are obtainable by conventional polymerisation processes.

A preferred polymerisation process is the commonly known inverse suspension technique in a hydrocarbon solvent in the presence of a polymeric stabilizer. The polymerisation process being initiated by a redox coupler. A dry polymer is recovered by azeotropic distillation of water and solvent.

A) Synthesis of the Cationic Polymer

This example illustrates the preparation of a suitable cationic polymer.

An 'aqueous phase' of water soluble components is prepared by admixing together the following components:

| | | |
|---|---|---|
| 51 | g | of acrylamid, |
| 118 | g | of methyl chloride quaternised dimethylamino ethyl acrylate |
| 0.13 | g | of a sequesterant |
| 0.0044 | g | of potassium bromate |

-continued

| | |
|---|---|
| 0.06125 g | 2,2-azobis(2-amidinopropane)dihydrochloride and water. |

A continuous 'oil phase' is prepared by admixing together the following components:

| | |
|---|---|
| 300 g | of Exxsol ® D40 (dearomatised hydrocarbon solvent) |
| 2 g | a polymeric stabilizer |

The continuous phase was deoxygenated by nitrogen gas for 20 minutes. Afterwards, the phase was agitated with a Rushton turbine stirrer at 400 rpm.

The monomer solution was then added to the agitated continuous phase and allowed to disperse for 3 minutes. The temperature of the suspension was adjusted to 25° C. The suspension was initiated by addition of Sulphur dioxide in Solvent D40 (0.656 ml of a 1% vol/vol solution).

When the exothermic reaction was completed, water was azeotroped off the suspension under reduced pressure. The resulting suspension of polymer beads was cooled to 25° C., filtered and air-dried. The obtained polymer has an average particle size of about 240 μm. The size is measured with a Sympatec HELOS laser diffraction apparatus (from Sympatec GmbH, Germany).

B) Preparation of a di(hydrogenated tallow)dimethyl Ammonium Methylchloride (DHTDMAC) Fabric Rinse Conditioner (5% Active Content)

To 1860 g deionised preheated water 139 g melted 50° C. DHTDMAC (Arquad 2HT-75) are slowly added under stirring. The dispersion is stirred and heated to 50° C. for 15 min under continuous stirring. The mixture is cooled down to 30° C. under stirring.

The pH-value is adjusted to 3.5.

The rinse conditioner is homogenized by stirring.

LV Brookfield Viscosity (22° C./30 rpm)=20 mPa/s.

C) Preparation of an Esterquat Fabric Rinse Conditioner (15% Active Content)

To 1370 g deionised preheated water 333 g melted 55° C. Esterquat (Rewoquat WE18) are slowly added under stirring. The dispersion is stirred for 10 min and then heated to 50° C. for 15 min. under continuous stirring. The mixture is cooled down to 30° C. under stirring.

The pH-value is adjusted to 3.5. The rinse conditioner is homogenized by stirring.

LV Brookfield Viscosity (22° C./30 rpm)=30 mPa/s.

D) Preparation of an Esterquat Fabric Rinse Conditioner (5% Active Content)

To 1890 g deionised preheated water 111 g of melted Esterquat (Stepantex VK90/VA90) is slowly added at 40° C. under stirring. The dispersion is stirred for 15 min.

Let cooling down the formulation to about 30° C. under agitation and adjust pH 3.5. The rinse conditioner is homogenized by stirring.

LV Brookfield Viscosity (22° C./30 rpm)=10/50 mPa/s.

Addition of the Thickener

The cationic polymer (in solid grade) is slowly added to each softener formulation at room temperature and under stirring until the formulation is homogenized.

The Brookfield viscosity is measured one day after preparation. The results are summarized in Table 1.

TABLE 1

| Softener Formulation | Polymer conc., (wt-%) (Polymer of A)) | LV Brookfield Viscosity (22° C./30 rpm/mPa · s) |
|---|---|---|
| Arquad 2HT 75-5% | — | 20 |
| Arquad 2HT 75-5% | 0.5 | 1440 |
| Rewoquat WE18-15% | — | 30 |
| Rewoquat WE18-15% | 0.5 | 1739 |
| Stepantex VK90-5% | — | 10 |
| Stepantex VK90-5% | 0.5 | 1219 |
| Stepantex VA90-5% | — | 50 |
| Stepantex VA90-5% | 0.5 | 1092 |

The invention claimed is:

1. A fabric softener composition comprising a fabric softener component or a mixture of fabric softener components and at least one polymer formed from the polymerisation of a mixture of monomers consisting of a) at least one cationic monomer selected from the group consisting of compounds according to formula (I)

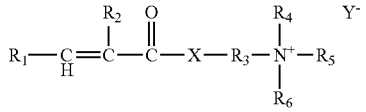

(I)

wherein $R_1$ signifies hydrogen or methyl, $R_2$ signifies hydrogen or $C_1$-$C_4$alkyl, $R_3$ signifies $C_1$-$C_4$alkylene, $R_4$, $R_5$ and $R_6$ signify independently from each other hydrogen or $C_1$-$C_4$alkyl, X signifies —O— or —NH— and Y signifies Cl; Br; I; hydrogensulphate or methosulfate and at least one non-ionic monomer of formula (II)

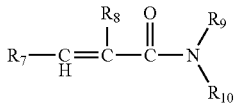

(II)

wherein $R_7$ signifies hydrogen or methyl, $R_8$ signifies hydrogen or $C_1$-$C_4$alkyl, and $R_9$ and $R_{10}$ signify independently from each other hydrogen or $C_1$-$C_4$alkyl, b) at least one cross-linking agent in an amount of less than 5 ppm by the weight of component a)

wherein the polymerisation optionally occurs in the presence of at least one chain transfer agent, and wherein the polymer when added to said composition is in the form of particles having an average particle size of more than 50 μm.

2. Fabric softener composition according to claim 1 wherein the polymer has a size of from 100 μm and up to 1000 μm when added to said composition.

3. Fabric softener composition according to claim 1 wherein the polymer is added to the compositions in the form of beads.

4. Fabric softener composition according to claim 1, wherein component a) comprises 35 to 95 wt-% of at least one cationic monomer and 5-65 wt-% of at least one non-ionic monomer, based on the total night of the polymer.

5. Fabric softener composition according to claim 1, wherein the cross-linking agent of component b) is selected from the group consisting of divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers.

6. Fabric softener composition according to claim 1, wherein the cross-linking agent of component b) is selected from the group consisting of tetra allyl ammonium chloride; allyl-acrylamides and allyl-methacrylamides; bisacrylamidoacetic acid and N,N'-methylene-bisacrylamide.

7. Fabric softener composition according to claim 1, wherein the chain transfer agent(s) c) is (are) selected from mercaptans; malic acid, lactic acid; formic acid; isopropanol and hypophosphites.

8. Fabric softener composition according to claim 1, wherein the chain transfer agent c) is present in a range of from 0 to 1000 ppm based on the component a).

9. Fabric softener composition according to claim 1, wherein the compositions comprise 0.005 to 15% by weight of the polymer.

10. Fabric softener composition according to claim 1, wherein the fabric softener components are selected from cationic quaternary ammonium salts, tertiary fatty amines having at least one $C_8$ to $C_{30}$ alkyl chain, carboxylic acids having 8 to 30 carbons atoms and one carboxylic group per molecule, esters of polyhydric alcohols, fatty alcohols, ethoxylated fatty alcohols, alkylphenols, ethoxylated alkylphenols, ethoxylated fatty amines, ethoxylated monoglycerides, ethoxylated diglycerides, mineral oils and polyols.

11. A liquid fabric softener composition according to claim 1 comprising:

A) 0.5 to 50 wt-%, based on the total weight of the composition, of the fabric softener;

B) 0.001 to 15 wt-%, based on the total weight of the composition, of at least one copolymer formed from the polymerisation of a mixture of monomers consisting of a) δ 95 wt-%, based on the on the total weight of the copolymer, of at least one monomer of formula (Ia)

(Ia)

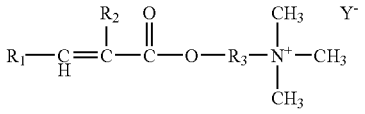

wherein $R_1$ signifies hydrogen or methyl, $R_2$ signifies hydrogen or methyl, $R_3$ signifies $C_1$-$C_2$alkylene and Y signifies Cl; Br or I, and b) 5-95 wt-%, based on the total weight of the copolymer, of at least one monomer of formula (IIa)

(IIa)

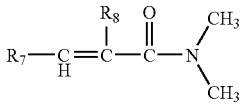

wherein $R_7$ signifies is hydrogen or methyl, and $R_8$ signifies hydrogen; methyl or ethyl, c) a cross-linking agent or a mixture of cross-linking agents selected from divinyl benzene; tetra allyl ammonium chloride; allyl acrylates and methacrylates; diacrylates and dimethacrylates of glycols and polyglycols; butadiene; 1,7-octadiene; allyl-acrylamides and allyl-methacrylamides; bisacrylamidoacetic acid; N,N'-methylene-bisacrylamide and polyol polyallylethers in an amount of less than 5 ppm based on component a), wherein the polymerisation occurs in the presence of 0-1000 ppm, based on component a); of at least one chain transfer agent selected from mercaptans; malic acid; lactic acid; formic acid; isopropanol and hypophosphites and wherein the polymer when added to said composition is in the form of particles having an average particle size of more than 50 μm C) 0 to 20 wt-%, based on the total weight of the composition, of customary additives; and D) 0 to 5 wt-%, based in the total weight of the composition, of a perfume;

E) 0 to 0.5 wt-%, based in the total weight of the composition, a component capable of sequestering metal ions and selected from the group consisting of:

i) chelating components selected from the group consisting of amino carboxylic acids, organo aminophosphonic acid components, and mixtures thereof, ii) polycarboxylic building components other than those defined under i) as chelating components, comprising at least two carboxylic radicals separated from each other by not more than two carbon atoms, and, iii) mixtures thereof; and F) water to 100%.

* * * * *

UNITED STATES PATENT AND TRADEMARK OFFICE

CERTIFICATE OF CORRECTION

PATENT NO. : 7,659,238 B2
APPLICATION NO. : 10/536607
DATED : February 9, 2010
INVENTOR(S) : Martin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 754 days.

Signed and Sealed this

Thirtieth Day of November, 2010

David J. Kappos

David J. Kappos
*Director of the United States Patent and Trademark Office*